US006375388B1

(12) United States Patent
Zoeller et al.

(10) Patent No.: US 6,375,388 B1
(45) Date of Patent: Apr. 23, 2002

(54) AFFLUENT DISTRIBUTION SYSTEM CAPABLE OF BEING HORIZONTALLY OFFSET OR CURVED

(75) Inventors: Kenneth E. Zoeller, Louisville; Matthew E. Byers, Lawrenceburg, both of KY (US)

(73) Assignee: Zoeller Company, Louisville, KY (US)

( * ) Notice: Subject to any disclaimer, the term of this patent is extended or adjusted under 35 U.S.C. 154(b) by 0 days.

(21) Appl. No.: 09/528,139

(22) Filed: Mar. 17, 2000

(51) Int. Cl.[7] ..... E02B 13/00
(52) U.S. Cl. ..... 405/43; 405/44; 405/46
(58) Field of Search ..... 405/36, 42, 43, 405/44, 46, 47; 210/532.2; 23/203

(56) References Cited

U.S. PATENT DOCUMENTS

| | | | | | |
|---|---|---|---|---|---|
| 3,645,100 | A | * | 2/1972 | La Monica | 405/46 |
| 3,931,992 | A | * | 1/1976 | Coel | 285/30 |
| 4,192,628 | A | * | 3/1980 | Gorman | 405/45 |
| 4,588,325 | A | * | 5/1986 | Seefert | 405/46 |
| 4,759,661 | A | | 7/1988 | Nichols et al. | |
| 5,017,041 | A | | 5/1991 | Nichols | |
| 5,087,151 | A | | 2/1992 | DiTullio | |
| 5,156,488 | A | | 10/1992 | Nichols | |
| 5,336,017 | A | | 8/1994 | Nichols | |
| 5,401,116 | A | | 3/1995 | Nichols | |
| 5,441,363 | A | | 8/1995 | Gray | |
| 5,498,104 | A | | 3/1996 | Gray | |
| 5,511,903 | A | | 4/1996 | Nichols et al. | |
| 5,556,231 | A | | 9/1996 | Sidaway et al. | |
| 5,588,778 | A | | 12/1996 | Nichols et al. | |
| 5,669,773 | A | * | 9/1997 | Daly et al | 405/48 |
| 5,839,844 | A | | 11/1998 | Nichols et al. | |
| 6,076,993 | A | * | 6/2000 | Gray | 405/43 |

* cited by examiner

*Primary Examiner*—David Bagnell
*Assistant Examiner*—Katherine W Mitchell
(74) *Attorney, Agent, or Firm*—Scott R. Cox

(57) ABSTRACT

An effluent distribution system for distributing effluent from a source of waste water, wherein the system includes a chamber, a cover or lid for the chamber, an effluent flow system, a pair of curved end sections secured at one end of the chamber for adjusting the position of one chamber in relation to another chamber, and treatment media wherein the chamber may include as an integral component thereof, the cover or lid and alternatively spray nozzles secured to the cover or lid to assist in the distribution of effluent.

23 Claims, 9 Drawing Sheets

AFFLUENT DISTRIBUTION SYSTEM CAPABLE OF BEING HORIZONTALLY OFFSET OR CURVED

RELATED APPLICATIONS

NONE

BACKGROUND OF INVENTION

1. Field of Invention

This invention relates to effluent distribution systems and more particularly to an effluent distribution system that can be adjusted to conform to the curvature of a trench in which the effluent distribution system is placed.

2. Background Art

Waste water and sewage disposal systems are designed to disperse waste water and/or effluent discharged from a waste water storage system or septic tank into an adsorption field. The effluent discharged from the septic tank is conventionally directed first into an effluent distribution box which then divides the flow of the effluent into separate quantities, each of which is passed through separate discharge pipes. The effluent is then discharged into the ground through perforations contained in the discharge piping. The perforated piping is preferably placed within trenches dug into the ground for this discharge. Typically, these trenches are partially filled with stone to permit better distribution of the effluent.

Recently this perforated piping system has sometimes been replaced by a series of molded plastic leaching chambers, sometimes referred to as leaching conduits. An example of this system is disclosed in U.S. Pat. No. 4,759,661. These leaching chambers are conventionally formed in the shape of inverted troughs, the sides of which contain slots through which the effluent is discharged into the trenches in which the leaching chambers are placed. Generally these chambers have open bottoms and sloped sides to assist in the distribution of the effluent. These chambers also each have open ends adapted to be locked together with other leaching chambers. Thus, one end of each chamber generally includes an overlap joint which is latched into a cooperating joint of an adjacent chamber. For economy of manufacture and distribution, typically each of these chambers are identical in shape and thus can be stacked together for shipment.

Many modifications have been made to these leaching chamber systems to permit easy attachment and to enhance the drainage from these chambers as disclosed, for example, in U.S. Pat. Nos. 5,017,041, 5,087,151, 5,156,488, 5,336,017, 5,401,116, 5,441,363, 5,498,104, 5,511,903, 5,556,231 and 5,839,844.

Typically, these chambers are joined end to end in an essentially straight line down the length of the trench using the overlap joints. Effluent pumped into these chambers is designed to flow from one chamber to the next chamber by gravity, necessitating careful placement of the chambers within the ground so that each successive chamber is slightly lower in the ground than the preceding chamber. This arrangement necessitates careful excavation of the trench, which is made more difficult where the ground is uneven or where the ground contains slopes.

Problems can occur with the placement of these leaching chambers if the trench in which the chambers are to be placed is not perfectly straight. In an attempt to address this problem, U.S. Pat. No. 5,588,778 discloses a leaching chamber, whose position within the trench can be adjusted horizontally. Variances in the position of these chambers in the trench are achieved by forming at least one end of each chamber into a shape which contains an angled terminus fixed at an angle greater than 90 degrees with respect to the chamber's longitudinal axis. This structure allows adjustment of the position of each chamber in relation to adjacent chambers up to about 9 degrees of angle. However, because of the structure of the terminus of these chambers, adjustments to the position of any series of chambers can only occur in one direction. In order to angle a chamber of this type in the opposite direction within the trench requires the manufacture of a second type of chamber with its terminus angled in a direction opposite from that of the other chambers.

Accordingly, it is an object of the invention to provide an effluent distribution system which is adaptable for use within a trench which may not be perfectly straight.

It is a further object of the invention to provide an effluent distribution system for use in a trench, whereby the individual components thereof can be angled in a clockwise or counterclockwise direction in relation to each other as desired or, they can be placed in a straight line within the trench.

It is a still further object of the invention to disclose an effluent distribution system utilizing leaching chambers, where the piping for the effluent can be located either within the chambers or on top of the chambers.

It is a still further object of the invention to disclose an effluent distribution system utilizing leaching chambers, wherein the effluent piping used for distribution of the effluent within the leaching chambers contains spray heads which assist in the efficient distribution of the effluent within the chambers.

It is a still further object of the invention to disclose an effluent distribution system utilizing leaching chambers, wherein each chamber contains a specialized connected at each end to assist in attachment of one chamber to the next chamber and which connector also permits axial movement of one chamber in relation to a second chamber.

It is a still further object of the invention to disclose an effluent distribution system utilizing a series of chamber units, wherein each chamber unit includes a support chamber and a separate detachable lid for that chamber.

These and other objects of the invention will be apparent from the effluent distribution system disclosed by the present invention.

SUMMARY OF INVENTION

The present invention discloses an effluent distribution system comprising a series of effluent distribution chamber units, wherein each chamber unit includes a chamber comprising a pair of side walls, a plurality of support ribs to support the side walls, and a first and second end, wherein a pair of curved end sections are secured to at least one end of the chamber; a separate cover or lid, which is securable to the chamber to cover the chamber; and an effluent flow system secured to the cover; wherein the pair of curved end sections are capable of rotatingly sliding within a second end of a second chamber unit to permit the position of the second chamber unit to be adjusted horizontally in relation to the position of the first chamber unit.

The present invention further includes a spraying system for distributing effluent within the chamber unit comprising a plurality of spray heads secured to pipes within the effluent flow system.

The invention further comprises a first connector section secured at the top of the first end of the chamber unit and a second connector section secured to the second end of a second chamber unit, wherein the first connector section of the first chamber when secured to the second connector section of the second chamber permits the position of the first chamber unit to be adjusted horizontally in relation to the position of the second chamber unit at least about +6 to about −6 degrees.

The present invention further includes a one-piece chamber unit comprising a leaching chamber, wherein the chamber includes a pair of side walls, a first and second end, a pair of curved end sections secured to the first end of the chamber, a cover formed as an integral component of the chamber and an effluent flow system secured to the cover, either below or above the cover, wherein the pair of curved end sections are capable of sliding within a second end of a second chamber unit to permit the position of the second chamber within a trench to be adjusted horizontally in relation to the position of the first chamber unit.

The invention further includes the use of a treatment media within the chamber units.

DETAILED DESCRIPTION OF A PREFERRED EMBODIMENT

Figure 1:
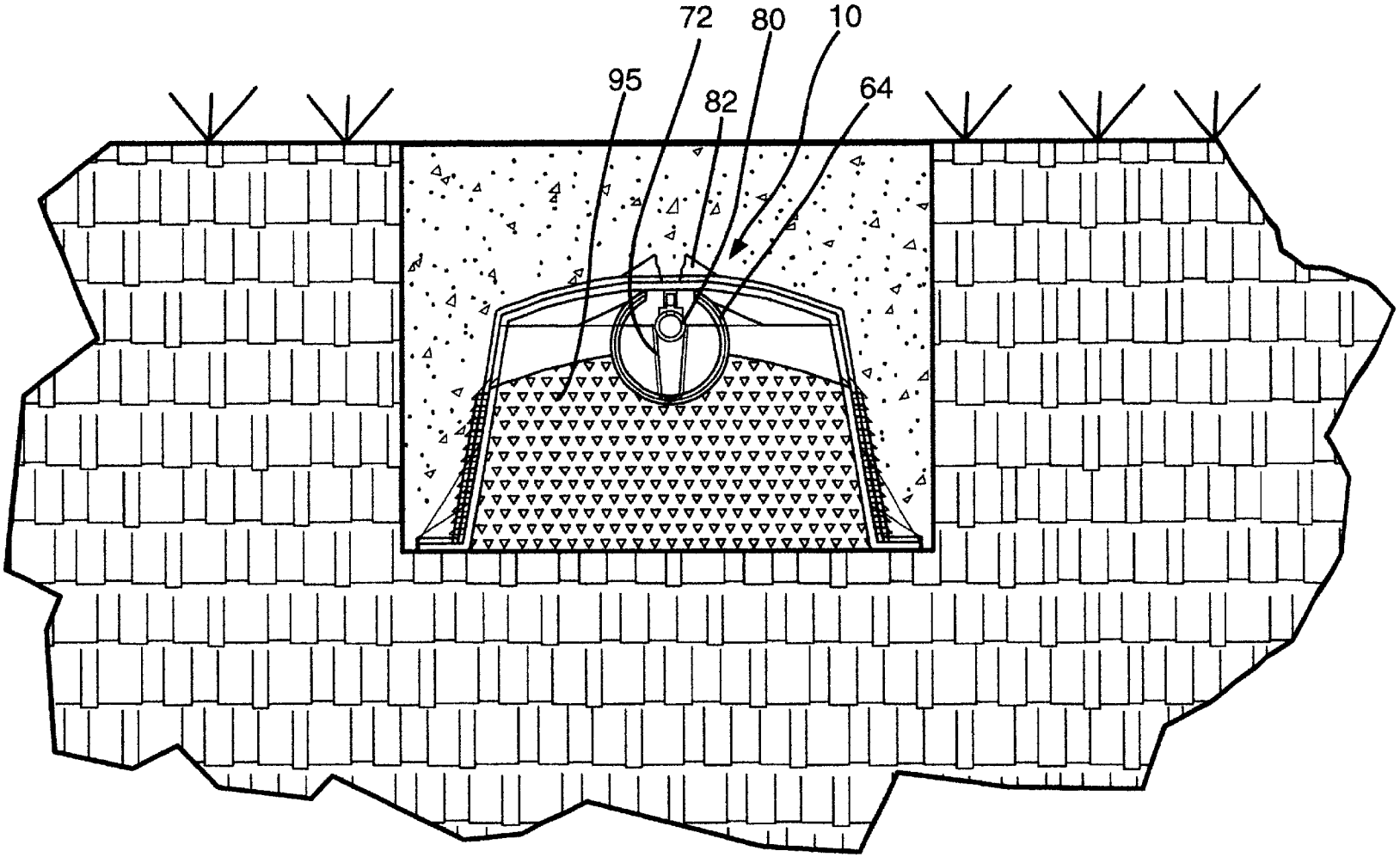
FIG. 1 is an end view of a first embodiment of an effluent distribution chamber unit in place in a trench in the ground with a piping system for the effluent secured inside a cover of the chamber unit.
Figure 11:
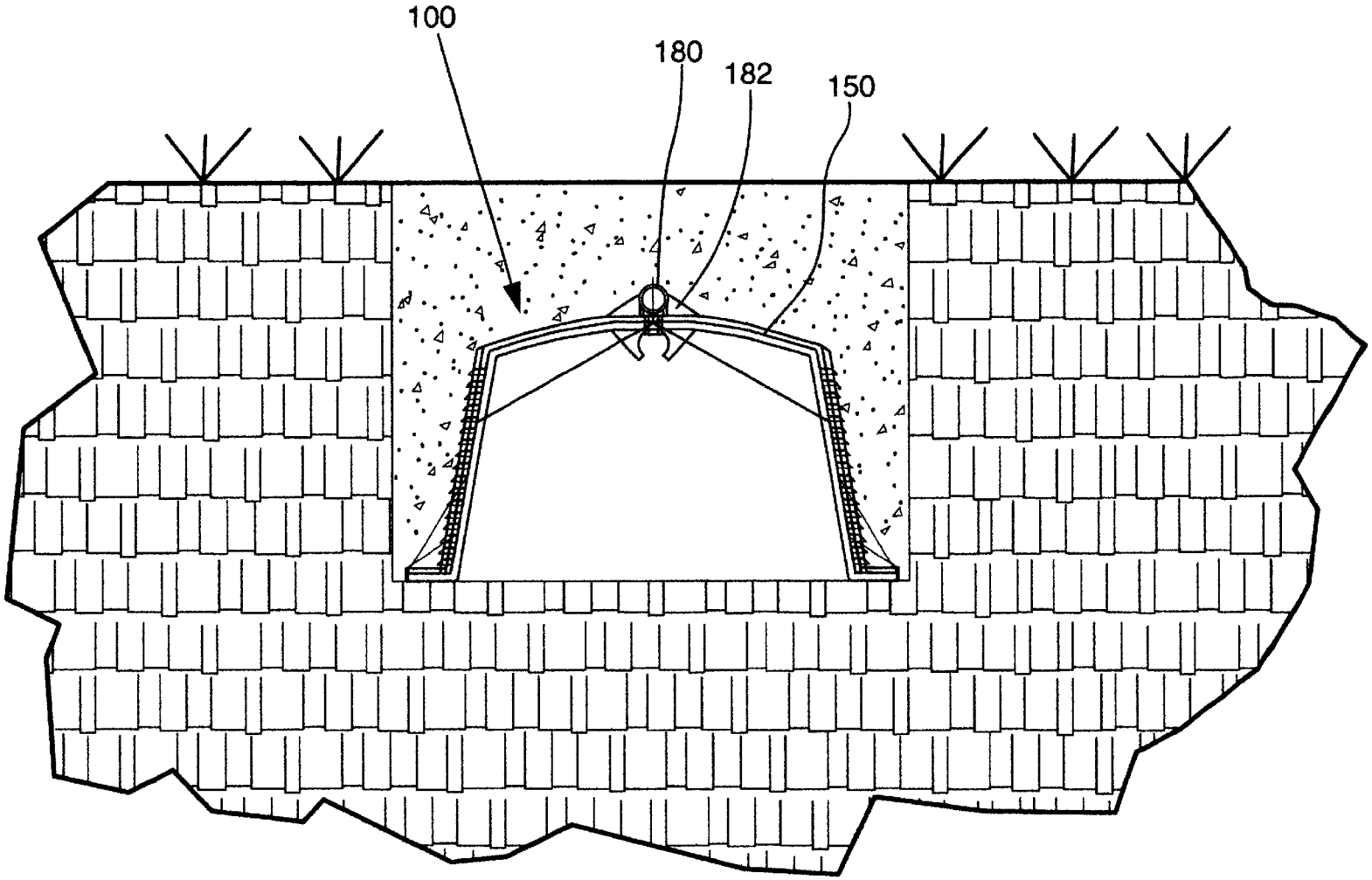
FIG. 11 is an end view of a one-piece second embodiment of an effluent distribution chamber unit in place in a trench in the ground with a piping system secured above a cover of the chamber unit.

The effluent distribution system of the present invention is designed to receive and distribute effluent from an effluent source, such as a septic tank, into an adsorption field. The effluent distribution system consists of a series of individual chamber units (10, 100) as shown in FIGS. 1 and 11 which are joined together to extend down a trench. The effluent passes through these chamber units (10, 100) in the trenches for distribution into adsorption fields in the ground.

Figure 6:
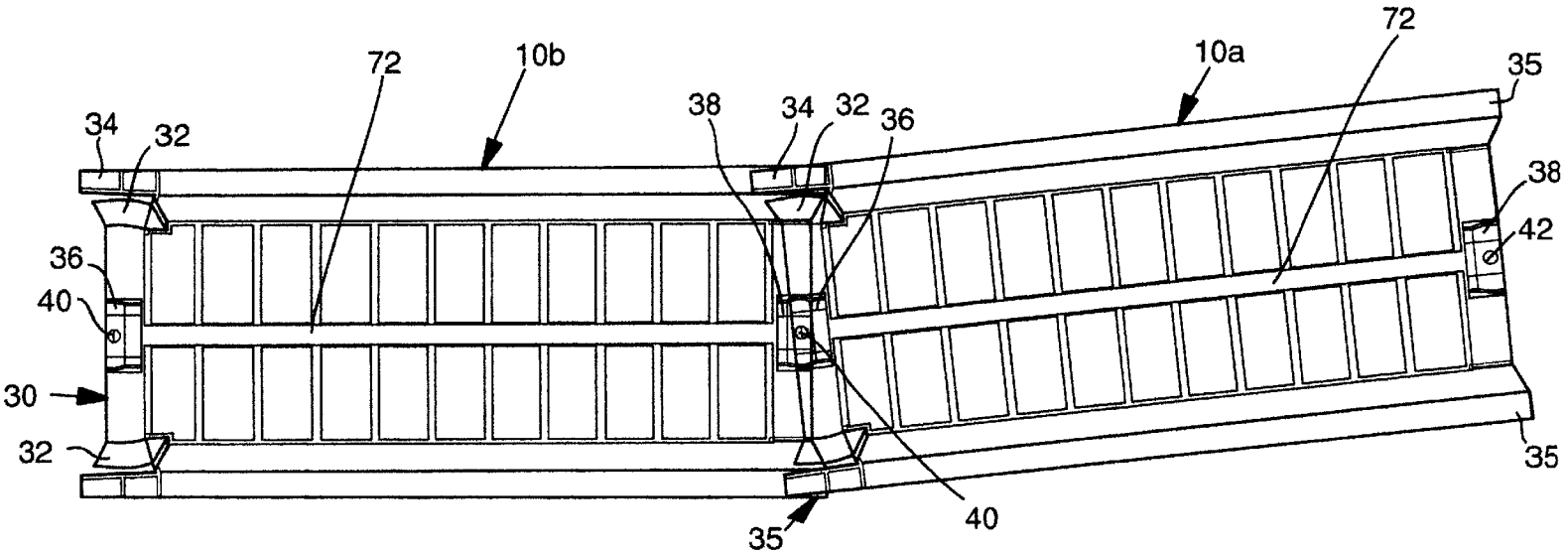
FIG. 6 is a top view of a first chamber secured to a second chamber, each with their respective covers removed, wherein the second chamber is angled horizontally away from the first chamber.
Figure 7:
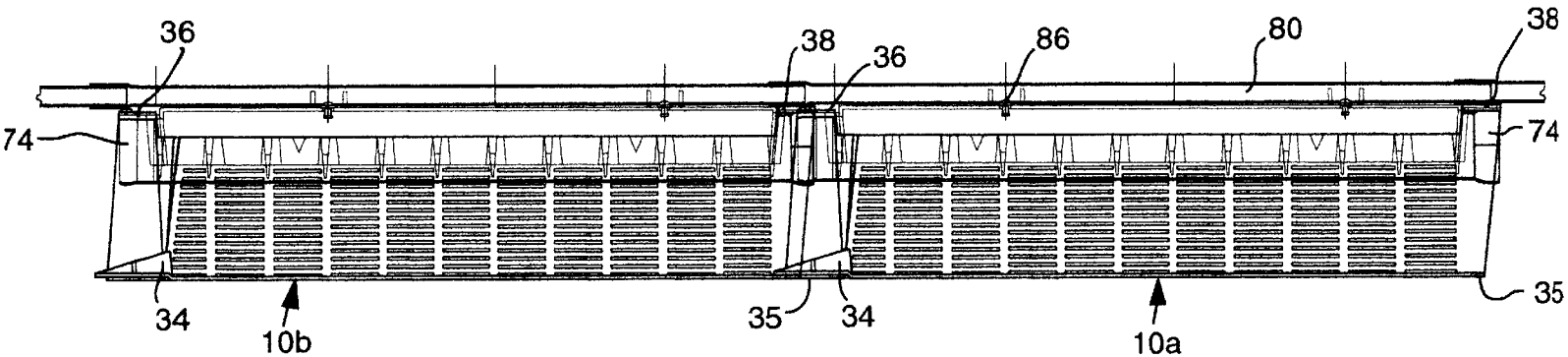
FIG. 7 is a side view of a first and second chamber units joined together with a piping system for effluent secured to the top of the covers of the chamber units.

In one preferred embodiment as shown in FIGS. 6 and 7, the effluent distribution system is comprised of a series of chamber units (10). A pair of chamber units (10), as shown in FIGS. 6 and 7, will be referenced respectively as a first chamber unit (10*a*) and a second chamber unit (10*b*). Each individual chamber unit (10) is comprised of a chamber (20), a cover or lid (50) and an effluent flow system (70), which distributes the effluent within the chamber unit (10).

Figure 2:
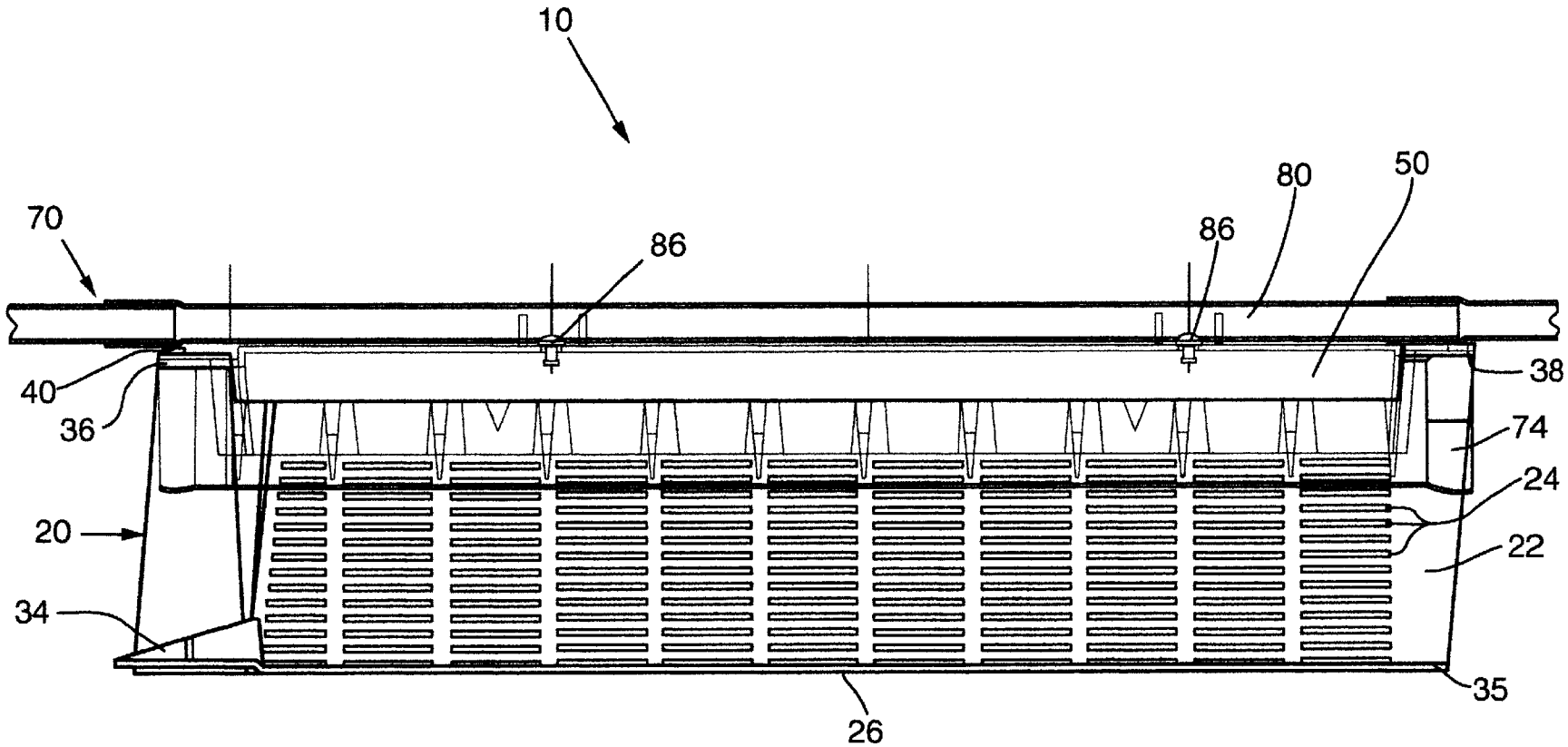
FIG. 2 is a side view of the effluent distribution chamber unit of FIG. 1 with the piping system for the effluent secured to the top of the cover.
Figure 3:
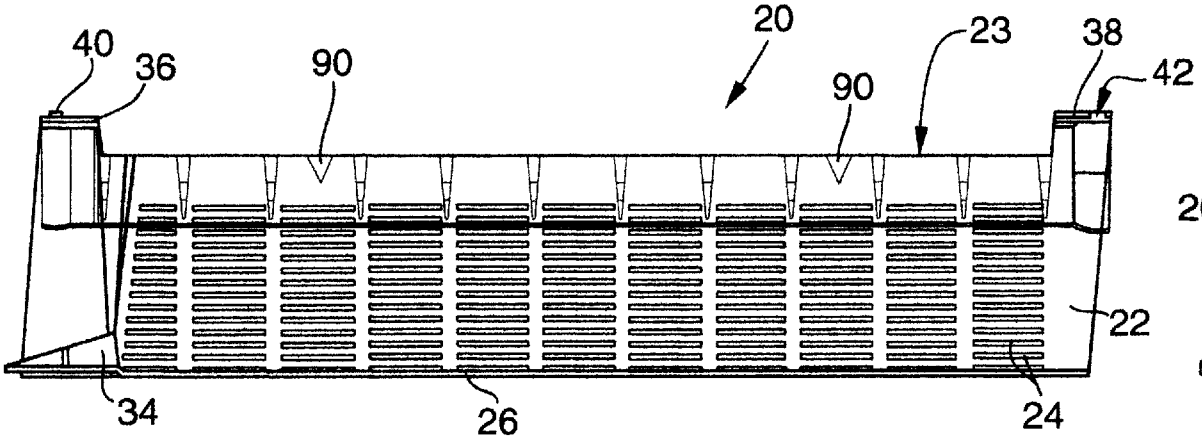
FIG. 3 is a side view of the chamber of the effluent distribution chamber unit of FIG. 1 with its cover removed.
Figure 4:
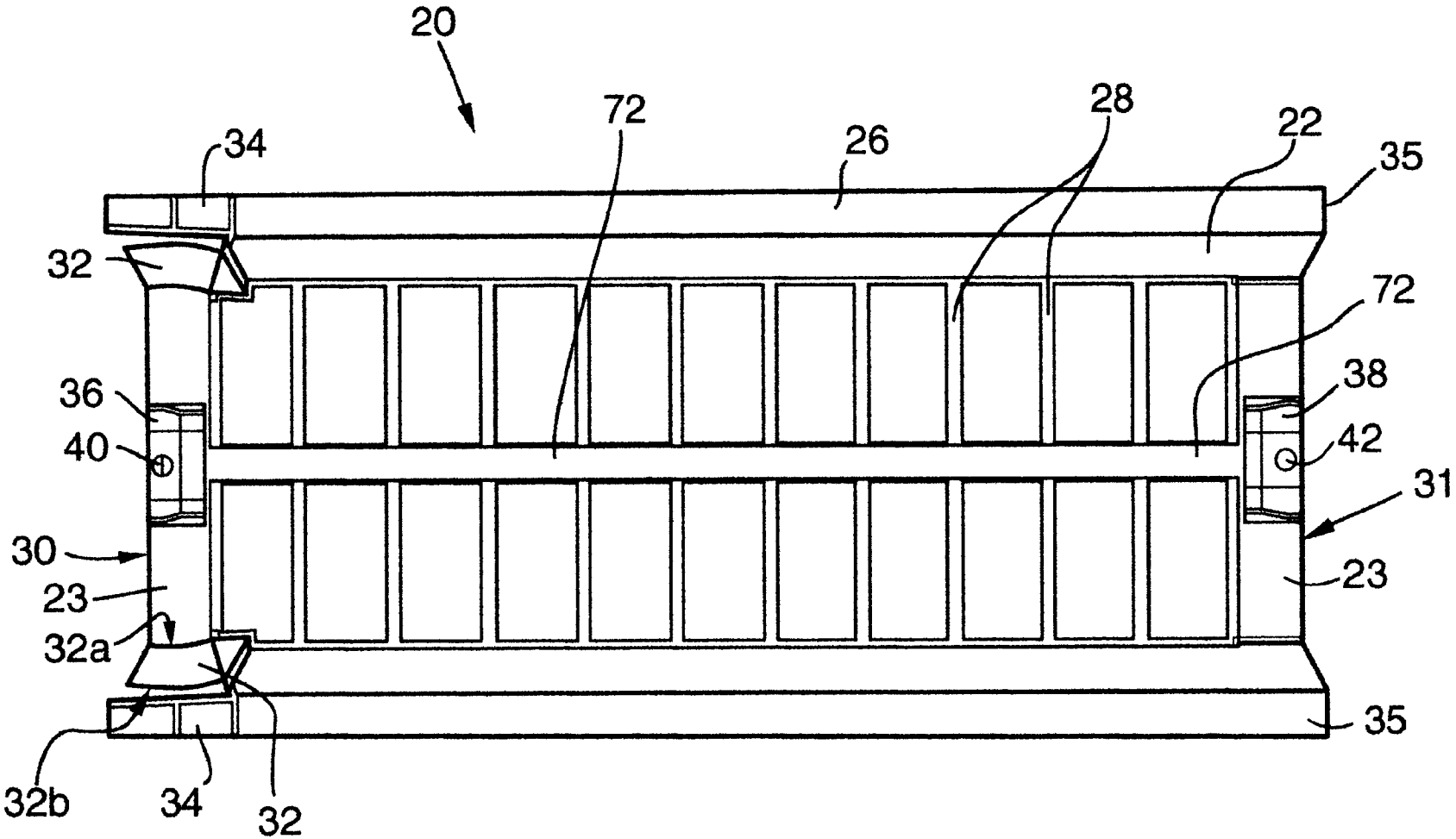
FIG. 4 is a top view of the chamber of FIG. 3.

The chamber (20) as shown in FIGS. 2, 3 and 4 is comprised of a pair of side walls (22) which include slots (24), preferably horizontal slots, a side wall foot support (26), present at the bottom of the side walls (22), a series of ribs (28) to support the chamber (20) passing across the top (23) of the chamber (20) from one side wall to the opposite side wall, a first and second end (30, 31) of the chamber (20) and a pipe support trough (72), which is sometimes used to support the effluent flow system (70).

The side walls (22), slots (24) in the side walls and the side wall foot supports (26) are conventional components of the chamber units (10). The choice of the type and structure of the slots (24), the number of slots (24) and the location of those slots (24) depends on the quantity of effluent intended to be distributed through the chamber unit (10). Extending across the top (23) of the chamber (20) between the side walls (22) as shown in FIG. 4 are a plurality of ribs (28) which support the side walls (22) and also support the cover (50).

A key aspect to the invention is the ability of the first chamber unit (10*a*) to adjust its position horizontally in relation to the second chamber unit (10*b*) as shown in FIG. 6. One element of the chamber (20) which enhances this adjustment capability is a pair of curved end sections (32) secured at the first end (30) of the chamber unit (10) as shown in FIGS. 4 and 6. These curved end sections (32) can be of any size, shape and structure which assists horizontal rotational movement of the first chamber unit (10*a*) in relation to the second chamber (10*b*) as shown in FIG. 6. In a preferred embodiment each of these curved end sections (32) are formed from plastic sections molded into the chamber (20), wherein each section is from about 4 to about 7 inches in length on its inside edge (32*a*) and from about 10 to about 19 inches in length on its outside edge (32*b*), with the outside edge (32*b*) angling through an arc from about 26° to about 19°, as shown in FIG. 4.

Adjacent to each of these curved end sections (32) and formed as an element of the side wall foot supports (26) at the first end (30) of the chamber unit (10) are preferably a pair of raised connector feet (34) as shown in FIGS. 2, 3 and 4. The bottom surface of each of these raised connector feet (34) is raised at least about ¼ inch above the level of the remaining portion of the side wall foot support (26) as shown in FIGS. 2 and 3. By being raised to a sufficient height, the connector feet (34) of the first chamber unit (10*a*) can slide over the opposite ends (35) of the side wall foot supports (26) of the corresponding second chamber unit (10*b*), allowing those opposite end portions (35) of the second chamber unit (10*b*) to pass below the connector feet (34) of the first chamber unit (10*a*) as shown in FIGS. 6 and 7. With this structure, the position of the first chamber unit (10*a*) can be adjusted horizontally in relation to the second chamber unit (10*b*), one position of which is shown in FIG. 6. The position of the first chamber unit (10*a*) can be angled at least about 5 degrees, and preferably at least about 5 to about 10 degrees in both a clockwise and counter clockwise direction in relation to the position of the second chamber unit (10*b*).

Figure 5:
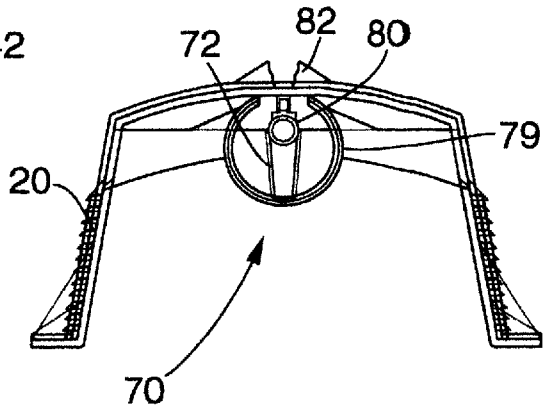
FIG. 5 is an end view of the chamber of FIG. 3.

Also preferably secured at the first end (30) of the chamber (20) to the top (23) surface of that chamber (20) is a connector section (36) as shown in FIGS. 4, 5 and 6. A cooperating second connector section (38) is then secured to the second end (31) of the chamber unit (10). Preferably the connector section (36) is generally rectangular shaped with its edges rounded and extending to the outside edge of the first end (30) of the chamber unit (20) as shown in FIG. 4. The connector section (36) is slightly higher and larger across than the second connector section (38) located at the opposite end (31) of the corresponding chamber unit (10) as shown in FIGS. 3, 6 and 7. When the first chamber unit (10*a*) is mated with the second chamber unit (10*b*) as shown in FIGS. 6 and 7, the first connector section (36) of the first chamber unit (10*a*) fits over the corresponding second connector section (38) of the second chamber unit (10*b*) because the first connector section (36) is slightly larger and raised slightly above the position of the second connector section (38). Because of the rounded edges, the second connector section (38) can pivot axially within the first connector section (36) to at least the same extent as the curved end section (32) of the first chamber unit (10*a*) can rotate within the corresponding end section (31) of the second chamber unit (10*b*).

Preferably located at the top of the second connector section (38) is a pivot post (40) which extends upward from the second connection section (38), preferably at least about ¼ inch. This pivot post (40) preferably fits within a pivot opening (42) cut into the first connector section (36) as shown in FIG. 6. As the first chamber unit (10*a*) pivots in relation to the second chamber unit (10*b*), the pivot post (40) located within the first connector section (36) of the first chamber unit (10*a*) rotates within the pivot opening (42) of the second connector section (38) of the second chamber unit (10*b*). The position of the first chamber unit (10*a*) in relation to the second chamber unit (10*b*) can be adjusted at least about 6 degrees clockwise and counter-clockwise by use of these connector sections (36, 38) and pivot posts (40) and pivot openings (42).

To assist in the attachment of a first chamber unit (10*a*) to a second chamber unit (10*b*), in a preferred embodiment, there is also provided a generally round joining element (74) as shown in FIGS. 2, 5 and 7. In order for the generally round joining element (74) of the first chamber unit (10*a*) to fit with a corresponding round joining element (74) of the second chamber unit (10*b*) requires that one be slightly larger in diameter than the other. Conventional mating systems to join such components together, such as dimple systems, can be utilized as is well known to persons skilled in the art.

The effluent flow system (70) can be any system which passes the effluent from one chamber unit (10) to the next chamber unit (10) for distribution. An effluent pump (not shown) can be used with the effluent flow system (70) to pump the effluent from its source, such as a septic tank, into and through the effluent flow system (70). Alternatively, the effluent can pass by gravity flow from the effluent source through the effluent flow system (70).

When a gravity flow system is used, a pipe support trough (72), is preferably used to receive and convey the effluent down the trench. The pipe support trough (72) is supported by the ribs (28) of the chamber (20) as shown in FIGS. 4 and 5. The pipe support trough (72) is preferably a U-shaped trough running the length of the chamber (20) as shown in FIG. 4 and formed as an element of the chamber (20).

When this gravity flow system is used, a pipe conveying the effluent is connected to the first end (30) of the first chamber unit (10*a*) in the effluent distribution system. The effluent then flows by gravity flow through the pipe into the pipe support trough (72). The pipe support trough (72) in this first chamber unit (10*a*) is connected to a second pipe support trough (72) in the second chamber unit (10*b*) by the trough (72) in the first chamber unit (10*a*) fitting within the trough (74) of the second chamber unit (10*b*) as shown in FIG. 6. Because each chamber unit (10) is slightly lower in the ground than the preceding chamber unit (10), the effluent flows by gravity from one pipe support trough (72) to the next pipe support trough (72). A dam (not shown) is secured at the end of the last pipe support trough in the last chamber unit to stop the flow of effluent. With this dam stopping the flow of the effluent, the effluent builds up within the respective pipe support troughs (72) until it overflows the sides of the pipe support troughs (72) for relatively even distribution of the effluent throughout the system.

In order to enhance the distribution of the effluent, weirs (90) are preferably cut into the sides of the respective pipe support trough (72), preferably at least two per chamber unit (10) as shown, for example, in FIG. 3. These weirs (90) enhance the distribution of the effluent through the respective chamber units. The depth of the cut of the weirs (90) can be adjusted from the first chamber unit (10*a*) to the second chamber unit (10*b*) to further equalize the distribution of the effluent among the respective chamber units (10).

In an alternative or additional embodiment, the effluent flow system (70) may include a pipe system (80). The use of the pipe system (80) requires a pump to be present (not shown), preferably in the septic tank or subsequent to the septic tank to pump the effluent through the piping system (80). In one embodiment, the pipe system (80) is supported by the pipe support trough (72) as shown, for example, in FIGS. 6 and 7. The pipe system (80) extends from the first end (30) to the second end (31) of each chamber (20) and slightly beyond. Each end of the pipes of the pipe system (80) is designed so that it can be mated with a corresponding pipe from the next chamber unit by conventional mating procedures as shown, for example, in FIGS. 7, 8 and 9. To force the effluent out of the pipes on a reasonably equal basis throughout the effluent flow system (70), spray heads (86) are secured within the pipe system (80), preferably two or more per chamber unit (10) as shown in FIGS. 2 and 7. The spray heads (86) are preferably designed to spray the effluent with a particular spray pattern within each of the chamber units (10), preferably with more of the effluent flowing axially with the pipe system (80) rather than radially to the sides of the pipe system (80).

Figure 9:
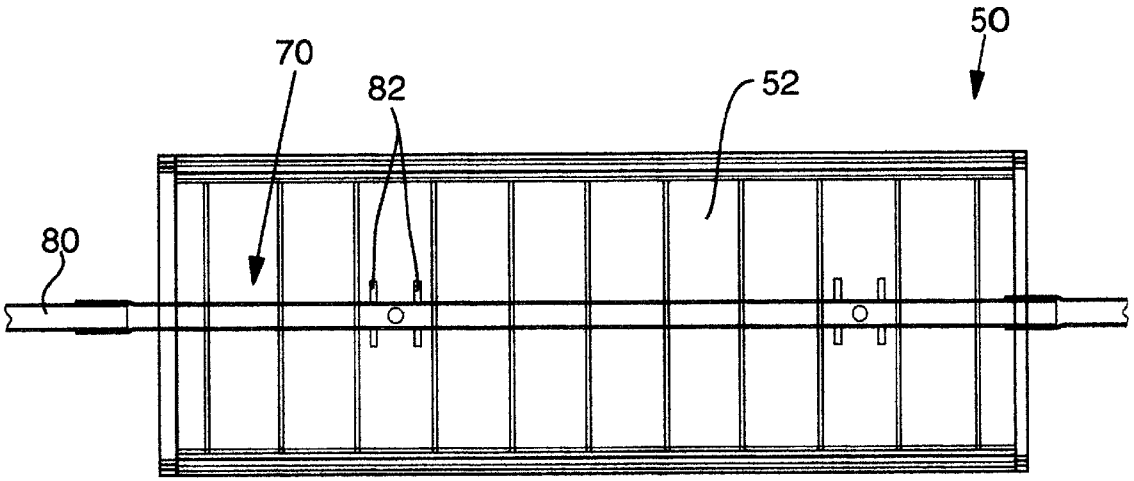
FIG. 9 is a top view of the cover of FIG. 8.
Figure 10:
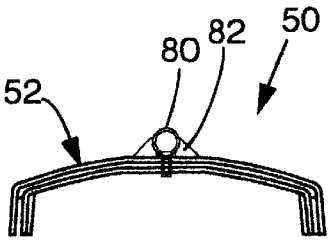
FIG. 10 is an end view of the cover of FIG. 8.

In an alternative or additional embodiment, the pipe system (80) may be secured to the top of the cover (50) by securing it to supports (82) built into the cover (50) of the chamber unit (10) as shown in FIGS. 1, 9 and 10. If the pipe system is secured to the top of the cover (50), the spray heads (86) must extend through the cover (50) to the inside of the chamber unit (10) as shown for example in FIG. 2.

Figure 8:
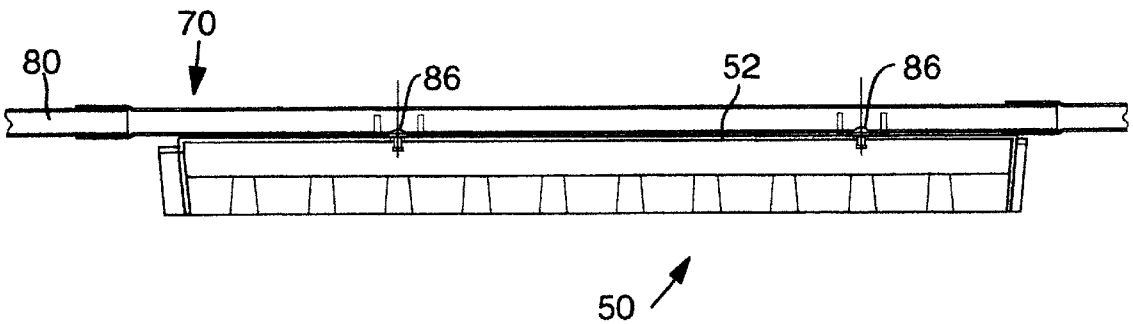
FIG. 8 is a side view of the cover of the effluent distribution chamber unit of FIG. 2.

In one preferred embodiment as shown in FIGS. 8, 9 and 10, the cover (50) is a separate component from the chamber (20). The cover (50) is designed to prevent dirt, rock and other material from entering the chamber (20). The cover (50) is supported by the chamber (20) with the pipe system (80), is used, secured to the top (52) of the cover (50). Alternatively, the piping system (80) can be secured within the cover (50) as shown in FIGS. 1 and 5. When secured within the cover (50) the pipe system (80) is preferably secured to the pipe support trough (72) as previously discussed. When this alternative embodiment is utilized, the cover (50) may also include one or more spray heads (86) secured to the piping system (80).

The chamber (20) is constructed of high strength plastic, such as structural foam polyethylene, and is preferably injection molded. The cover or lid (50) is constructed of the same type of high-strength plastic material as is the chamber (20) and is designed with enough strength to support dirt and rock and other materials that are present in conventional effluent distribution trenches.

Figure 16:
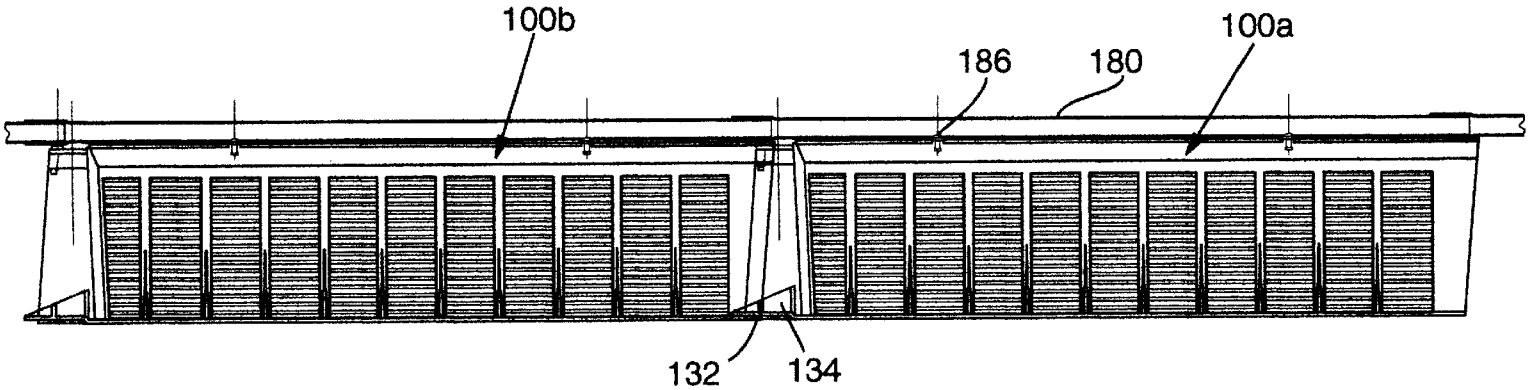
FIG. 16 is a side view of the first and second chamber units of FIG. 15.

In a second preferred embodiment as shown in FIGS. 11–16, the chamber unit (100) is a one-piece chamber (120) with built-in cover (150). The one-piece chamber unit (100) with built-in cover (150) as shown in FIGS. 12, 13, 14, 14*a* and 15 is comprised of a chamber (120), side walls (122), slots in the side walls (124), side wall foot supports (126) and cover (150), injection molded as a single unit. These components are similar to, or the same as, the complimentary components in the two-piece system. A pair of chamber units (100) of this second preferred embodiment as shown in FIGS. 16 and 17 are referred to as a first one-piece chamber unit (100*a*) and a second one-piece chamber unit (100*b*).

Figure 13:
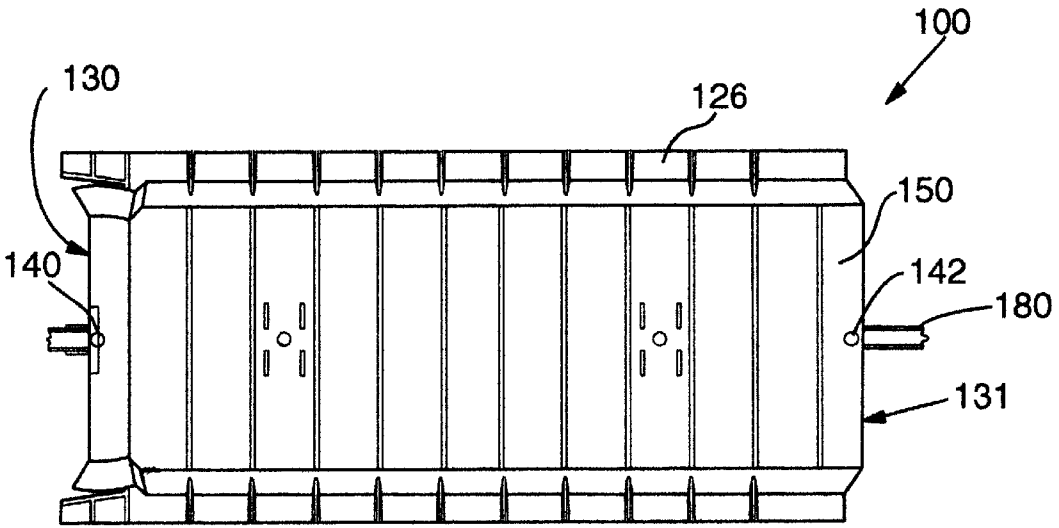
FIG. 13 is a top view of the second embodiment of the effluent distribution chamber unit of FIG. 11 with the piping system removed.

This one-piece chamber unit (100) preferably also includes first and second ends (130, 131), curved end sections (132) and connector feet (134), as shown in FIG. 13, which are similar to those elements of the first embodiment. Preferably a center pivot post (140) and center pivot opening (142) are also provided in the chamber unit (100), one at each end (130, 131), which allow the first one-piece chamber unit (100*a*) to rotate around the second one-piece chamber unit (100*b*) as shown, for example, in FIGS. 15 and 16.

Figure 14A:
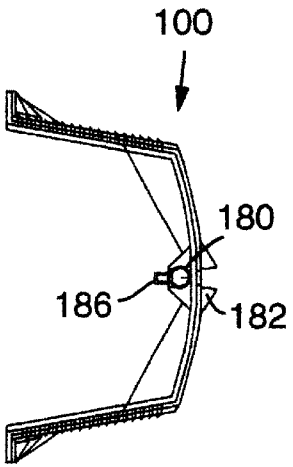
FIG. 14*a* is an end view of the second embodiment of the effluent distribution chamber unit of FIG. 11 with the piping system secured below the cover.
Figure 14:
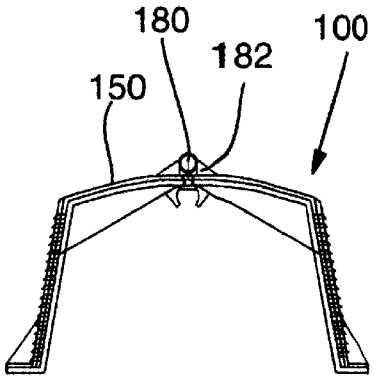
FIG. 14 is an end view of the second embodiment of the effluent distribution chamber unit of FIG. 11 with the piping system secured above the cover.
Figure 12:
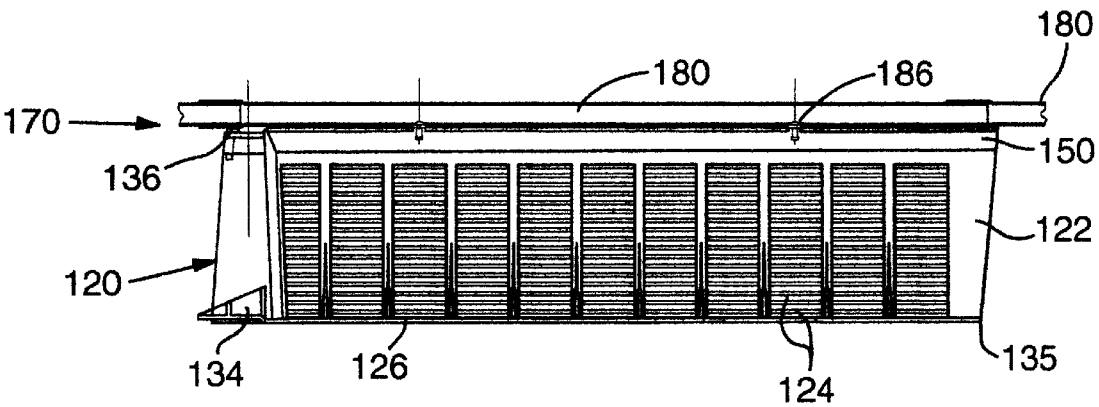
FIG. 12 is a side view of the second embodiment of the effluent distribution chamber unit of FIG. 11.
Figure 15:
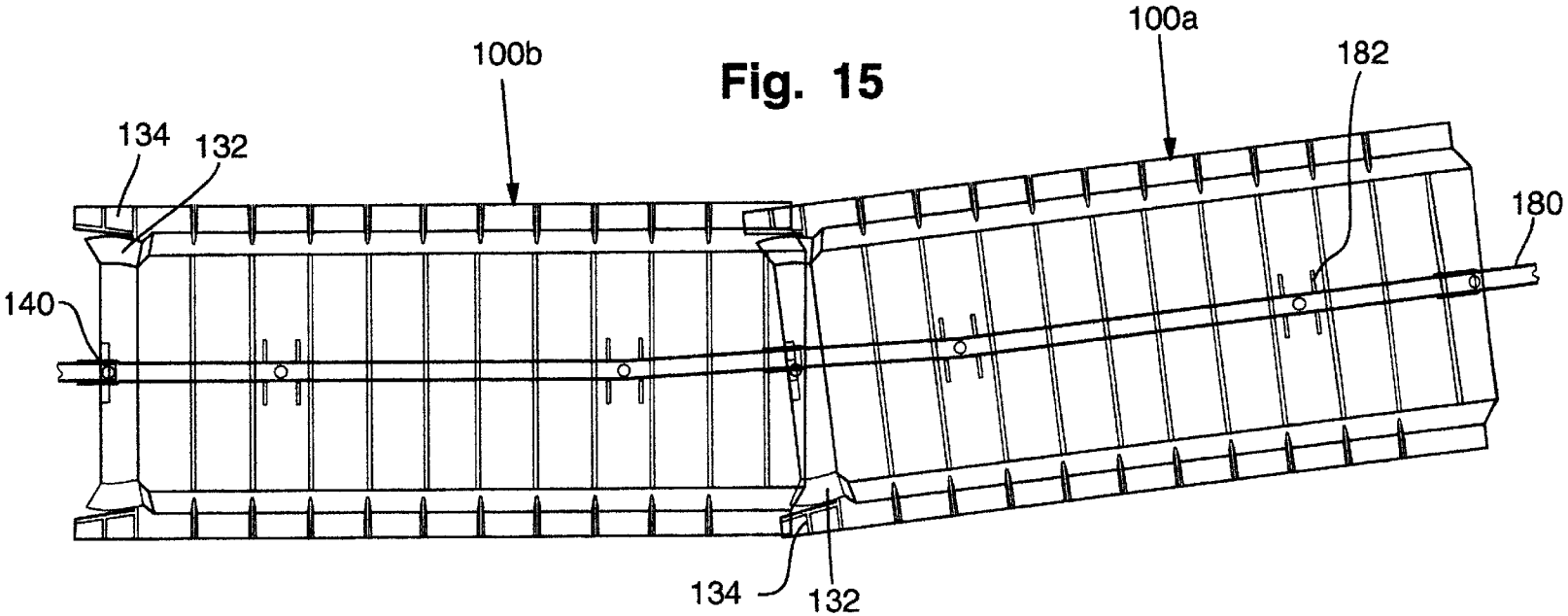
FIG. 15 is a top view of a first chamber unit of the second embodiment of the invention as shown in FIG. 13 secured to a second chamber unit, with a piping system secured to the top of the chamber units, with the position of the second chamber unit angled away from the position of the first chamber unit.

This one-piece chamber unit (100) may also includes a pipe system (180) as shown in FIGS. 12 and 13. This pipe system (180) can be supported either within the chamber unit (100) as shown in FIGS. 13 and 14*a* or on top of the chamber unit (100) as shown in FIGS. 12 and 14. A plurality of spray heads (186) are then preferably secured to the pipe system (180) of this one-piece chamber unit (100) as shown in FIG. 12 and are the same type as discussed for the two-piece chamber units (10).

This effluent distribution system is especially designed for use with various treatment media. Such treatment media may be placed within either of the chamber units (10, 100), but preferably is used within the two-part chamber units (10) as shown in FIG. 1, to allow for treatment of the effluent as it is introduced into the chamber units (10). The treatment media (95) may include materials which are inert and/or active in the filtration and treatment of the effluent. For example, the treatment media (95) may include one or more of the following types of inert materials: rock, sand, peat, gravel, dirt or other such inert material. Alternatively, or in addition to inert materials, active materials which chemically transform the effluent may be chosen for use within the chamber units, such as crushed brick. Any other types of media (95) which can either absorb or treat effluent may be chosen for use as the treatment media (95).

In use, the designer decides whether to use a two-piece chamber unit (10) or a one-piece chamber unit (100). Also, the designer decides whether to use a gravity flow system (70) or a pipe system (80, 180) attached to an effluent pump (not shown). (For ease of reference a first chamber of the two-piece chamber unit (10) is referenced as "20*a*" and a second chamber is referenced as "20*b*" as shown in FIGS. 6 and 7. After the trench is dug, the first chamber (20*a*) of the two-piece system, if chosen, is placed in proper position within the trench. A second chamber (20*b*) is then connected to the first chamber (20*a*). In making this connection, the center pivot post (40) of the first end (30) of the first chamber (20*a*) is placed within the pivot opening (42) in the second end (31) of the second chamber (20*b*). The curved end section (32) of the first chamber (20*a*) also slides within the second end (31) of the second chamber (20*b*). In addition, the connector section (36) on the first end (30) of the first chamber (20*a*) snaps over the connector section (38) of the second chamber (20*b*). Further, the joining element (74) of the first chamber (20*a*) snaps within the joining element (74) of the second chamber (20*b*). The exact placement of the second chamber (20*b*) is then adjusted in relation to the first chamber (10*a*) to best fit within the trench. Because of the curved end sections (32), the connector sections (36, 38), the center pivot (40) and center pivot opening (42) and the joining elements (74), the relative position of the second chamber (20*b*) can be adjusted by as much as 10 degrees clockwise or counterclockwise in relation to the first chamber (20*a*). Once all of the chambers (20) are in place within the trench, treatment media (95), if desired, is placed within the respective chambers (20). The pipe system (80), if chosen, is then secured in position. The pipe system (80) may be secured to the chamber (20) or it may be secured to the cover or lid (50) of the chamber (20). Alternatively, the gravity flow system using the pipe support troughs (72) may be chosen. Once all of the respective chambers (20) and pipe systems (80) are in place, with or without the treatment media (95), each of the respective lids (50) are secured to their respective chamber (20). The trench is then filled and the chamber units (10) are ready for use as an effluent distribution system.

Alternatively, if a one-piece chamber unit (100) is to be used, each of the one-piece chambers (120) with built-in covers (150) are first put in position within the trench. To adjust the relative position of the chamber units (100), the curved end section (132) of the first chamber unit (100*a*) is rotated in position relative to the second end (131) of the second chamber unit (100*b*). In addition, the center pivot (140) of the first end (130) of the first one-piece chamber unit (100*a*) is placed within the pivot opening (100*b*) at the second end (131) of a second one-piece chamber (162). The designer then decides whether to choose a gravity fed effluent distribution system or one that utilizes a piping system (180). If a pipe system (180) is chosen, it is then placed in position. Either the pipe system (180) is already in position within the inside of the one-piece chamber (120), if that embodiment is chosen, or the pipe system (180) is placed within the pipe support (182) on the top of the one-piece chamber unit (120) with built-in lid (150). Because of the curved end sections (132), pivot posts (140) and pivot openings (142), the position of each of the chamber units (100) can be adjusted axially in relation to the adjacent chamber unit providing great flexibility in the installation of this effluent distribution system within a trench. Once all of the one-piece chambers (120) with built-in lids (150) are in position, the trench is filled and the effluent distribution system is connected to the septic tank for use.

It will be apparent from the foregoing that while particular forms of the invention have been illustrated and described, various modifications can be made without departing from the spirit and scope of the invention.

We claim:

1. An effluent distribution system comprising a first chamber comprising a pair of side walls, a plurality of support ribs which support the side walls, a first and second end, and a pair of curved end sections secured to the first end of the chamber;

a cover, which is securable to the chamber; and an effluent flow system, wherein each curved end section is capable of rotation within a second end of a second chamber, and wherein the rotation of the curved end sections permits a position of the second chamber to be adjusted at various angles horizontally in relation to a position of the first chamber.

2. The effluent distribution system of claim 1 wherein the effluent flow system comprises a trough secured to the support ribs of the chamber.

3. The effluent distribution system of claim 1 wherein the chamber further comprises a side wall foot support.

4. The effluent distribution system of claim 1 wherein the effluent flow system comprises a pipe system secured to the cover.

5. The effluent distribution system of claim 4 further comprising spray heads secured to the pipe system.

6. The effluent distribution system of claim 2 further comprising a pipe system secured to the trough.

7. The effluent distribution system of claim 6 further comprising spray heads secured to the pipe system.

8. The effluent distribution system of claim 1 wherein the chamber further comprises a pivot post secured to a top portion of the chamber at the first end of the chamber.

9. The effluent distribution system of claim 8 wherein the chamber further comprises a pivot opening located in the top portion of the chamber at the second end of the chamber.

10. The effluent distribution system of claim 1 further comprising a first connector section secured to the first end of the chamber and a second connector section secured to the second end of a second chamber, wherein the first connector section of the first chamber is capable of rotatingly fitting within the second connector section.

11. The effluent distribution system of claim 2 further comprising weir openings in the trough.

12. The effluent distribution system of claim 1 wherein the chamber further comprises a generally round, joining element secured to each of the first and second ends.

13. An effluent distribution system comprising a one-piece chamber and cover system comprising a chamber;

a pair of side walls secured to the chamber;

a cover fixedly secured to the side walls of the chamber;

a pair of curved end sections secured at a first end of the chamber; and an effluent flow system secured to the cover, wherein each curved end section is capable of rotation within a second end of a second one-piece chamber and cover system and wherein said rotation of the curved end sections permits a position of the second one-piece chamber and cover system to be adjusted at various angles horizontally in relation to a position of the first one-piece chamber and cover system.

14. The effluent distribution system of claim 13 wherein the effluent flow system is secured to a top of the cover or lid.

15. The effluent distribution system of claim 13 wherein the effluent flow system is a piping system.

16. The effluent distribution system of claim 15 further comprising spray heads secured to the piping system.

17. The effluent distribution system of claim 13 further comprising side wall foot supports.

18. The effluent distribution system of claim 13 wherein the effluent flow system comprises a trough secured to the support ribs of the chamber.

19. The effluent distribution system of claim 13 wherein the chamber further comprises a pivot post secured to a top portion of the chamber at the first end of the chamber.

20. The effluent distribution system of claim 19 wherein the chamber further comprises a pivot opening located in the top portion of the chamber at the second end of the chamber.

21. The effluent distribution system of claim 13 further comprising a first connector section secured to the first end of the first chamber and cover system and a second connector section secured to the second end of the second chamber and cover system, wherein the first connector section is capable of fitting within the second connector section.

22. The effluent distribution system of claim 13 further comprising treatment media contained within the chamber.

23. An effluent distribution system comprising a first chamber comprising a pair of side walls, a plurality of support ribs which support the side walls, a first and second end, and a pair of curved end sections secured to the first end of the chamber;

a cover, which is securable to the chamber;

an effluent flow system; and treatment media contained within the chamber, wherein each curved end section is capable of rotation within a second end of a second chamber, and wherein the rotation of the curved end sections permits a position of the second chamber to be adjusted at various angles horizontally in relation to a position of the first chamber.

* * * * *